US006462638B2

(12) United States Patent
Imada et al.

(10) Patent No.: US 6,462,638 B2
(45) Date of Patent: Oct. 8, 2002

(54) COMPLEX ELECTRONIC COMPONENT

(75) Inventors: Katsuhisa Imada, Yokaichi; Motoi Nishii, Omihachiman; Hiroyuki Takeuchi, Shiga-ken; Naotaka Oiwa, Yokaichi; Yoshihiro Nishinaga, Hikone, all of (JP)

(73) Assignee: Murata Manufacturing Co., Ltd., Nagaokakyo (JP)

( * ) Notice: Subject to any disclaimer, the term of this patent is extended or adjusted under 35 U.S.C. 154(b) by 0 days.

(21) Appl. No.: 09/884,157

(22) Filed: Jun. 20, 2001

(65) Prior Publication Data

US 2001/0030593 A1 Oct. 18, 2001

Related U.S. Application Data

(62) Division of application No. 09/110,139, filed on Jul. 6, 1998, now Pat. No. 6,294,976.

(30) Foreign Application Priority Data

Jul. 4, 1997 (JP) ..... 9-195116

(51) Int. Cl.[7] ..... H01F 5/00
(52) U.S. Cl. ..... 336/200; 336/223; 336/232
(58) Field of Search ..... 336/200, 223, 336/232

(56) References Cited

U.S. PATENT DOCUMENTS

| | | | |
|---|---|---|---|
| 3,613,033 | A | 10/1971 | Denes |
| 4,918,417 | A | 4/1990 | Sakamoto |
| 5,045,380 | A | 9/1991 | Kobayashi et al. |
| 5,051,712 | A | 9/1991 | Naito et al. |
| 5,250,923 | A | 10/1993 | Ushiro et al. |
| 5,453,316 | A | 9/1995 | Morii et al. |
| 5,592,134 | A | 1/1997 | Ogata et al. |

FOREIGN PATENT DOCUMENTS

| | | |
|---|---|---|
| JP | 1-179413 | 12/1989 |
| JP | 5-152137 | 6/1993 |
| JP | 5-326271 | 12/1993 |
| JP | 7-10914 | 2/1995 |
| JP | 7-37744 | 2/1995 |
| JP | 7-106131 | 4/1995 |
| JP | 8-273979 | 10/1996 |

*Primary Examiner*—Anh Mai
(74) *Attorney, Agent, or Firm*—Burns, Doane, Swecker & Mathis, LLP

(57) ABSTRACT

When a plurality of devices are disposed in parallel in a magnetic ceramic laminated member to form a complex electronic component, an insulating member is disposed between adjacent devices. When adjacent devices among a plurality of devices are disposed on different planes in a magnetic ceramic laminated member to form a complex electronic component, an insulating member is disposed at least at a part of an intermediate layer positioned between the adjacent devices in the lamination direction.

1 Claim, 6 Drawing Sheets

FIG. 5A
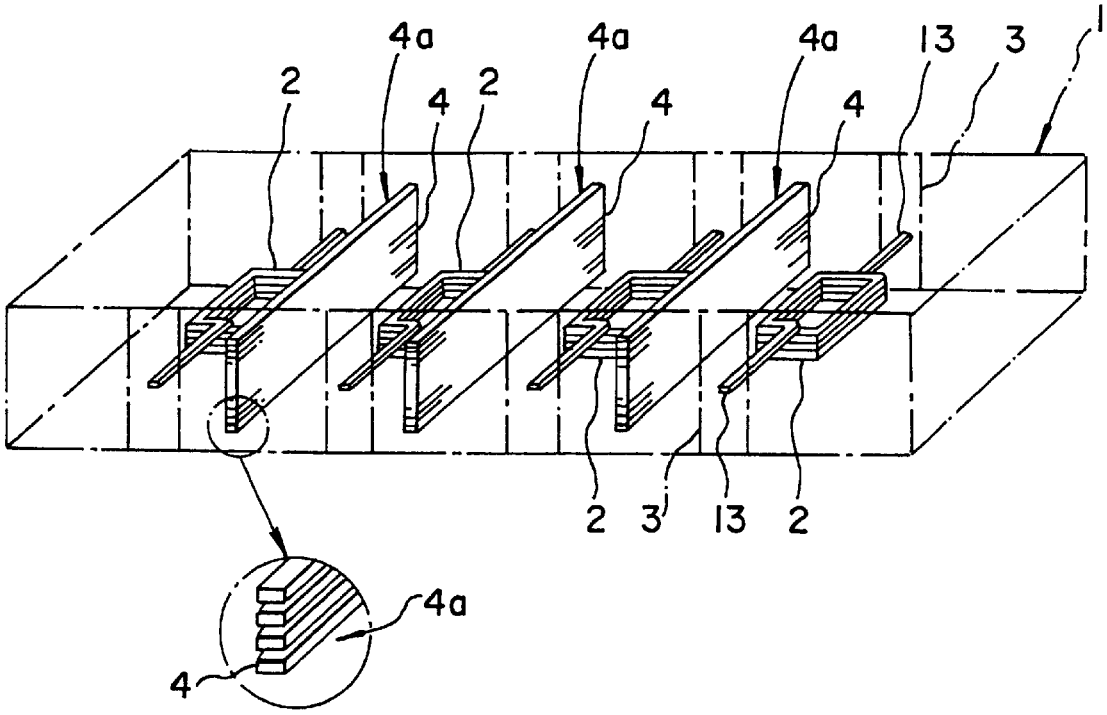
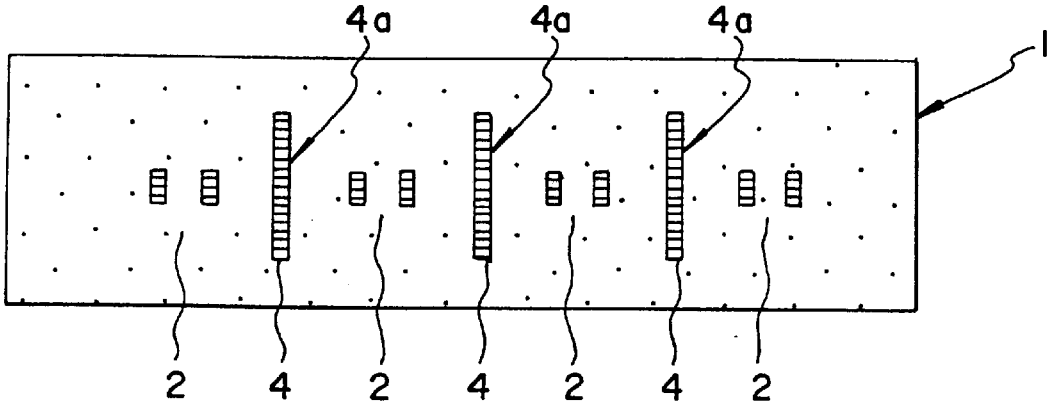
FIG. 5B

COMPLEX ELECTRONIC COMPONENT

This application is a division of application Ser. No. 09/110,139, filed Jul. 6, 1998, now U.S. Pat. No. 6,294,976.

This application is based on Japanese Patent Application No. 9-195116, which was filed on Jul. 4, 1997, and which is incorporated by reference in its entirety herein.

BACKGROUND

1. Field of the Invention

The present invention relates to complex electronic components, and more particularly, to a complex electronic component having a structure in which a plurality of devices, such as an inductor, a resistor, and a capacitor, are disposed in ceramic.

2. Description of the Related Art

As a conventional noise-canceling interface (noise-canceling filter device) used in an interface line of an office automation unit such as a computer, a complex inductor component (complex electronic component) such as that shown in FIG. 7 is used. This integrally-baked complex inductor component is formed in order to reduce a space required for mounting to allow high-density mounting such that a plurality of inductors 2 having a coil shape and serving as inner electrode layers 12 are disposed in line on the same plane inside a laminated member 1 formed by laminating magnetic ceramic (ferrite) layers, and a plurality of outer electrodes 3 which are electrically connected to the inductors 2 through lead electrodes 13 are disposed outside the laminated member 1.

When a high voltage is applied to each inductor of the conventional complex inductor component, however, migration of the inner electrodes may occur along a laminated surface or insulation resistance may decrease, due to at least the following reasons:

1) short distances between the inductors;
2) arrangement of the inductors on the same magnetic ceramic (ferrite) layer; and
3) not-very-high insulation capability, e.g., an insulation resistance of about $10^9$ to $10^{10}$ Ω·cm in magnetic ceramic (ferrite).

SUMMARY

It is an object of the present invention to provide a complex electronic component which can prevent migration of the inner electrodes and can provide a reduction in insulation resistance and also has a good insulation reliability between devices.

The foregoing objects and others are achieved according to one aspect of the present invention through the provision of a complex electronic component including: a plurality of devices disposed in parallel in magnetic ceramic; and an insulating member disposed between adjacent devices to enhance insulation therebetween.

Since the insulating member is disposed between adjacent devices, insulation between the devices is enhanced, and migration of an inner electrode and a reduction in insulation resistance are prevented. Insulation reliability between devices is also increased.

The foregoing objects and others are also achieved according to another aspect of the present invention through the provision of a complex electronic component including: a plurality of devices disposed in parallel in a laminated member formed by laminating a magnetic ceramic layer and an inner electrode constituting a device, adjacent devices among the plurality of devices being disposed on different planes inside the laminated member; and an insulating member disposed at least at a part of an intermediate layer positioned between the adjacent devices in the lamination direction to enhance insulation between the adjacent devices.

Since the adjacent devices among the plurality of devices are disposed on different planes inside the laminated member, migration of an inner electrode is even more unlikely to occur and a reduction in insulation resistance can be more effectively prevented. Since the insulating member is disposed at least at a part of an intermediate layer, positioned between the adjacent devices in the lamination direction, insulation reliability between devices is increased.

In the complex electronic component, the insulating member may be a wall-shaped insulating member which is formed by laminating insulating elements between the adjacent devices. The wall shaped insulating member also partitions zones where the adjacent devices are disposed.

Since insulating elements are laminated between the adjacent devices to form a wall-shaped insulating member which partitions zones where the adjacent devices are disposed, migration of an inner electrode and a reduction in insulation resistance are prevented. Insulation between the adjacent devices is further enhanced. Insulation reliability is substantially increased.

The wall-shaped insulating member can be easily formed, for example, by laminating, when the device is formed, ceramic green sheets on which an insulating pattern is disposed.

In the present invention, the wall-shaped insulating member is a broad-concept term and includes one formed by laminating a plurality of insulating layers through ceramic green sheets, which has gaps, and one having a wall without gaps. No special limitation is applied to the wall-shaped insulating member in terms of its shape and manufacturing method.

In the complex electronic component, the magnetic ceramic may have an insulation resistance of approximately $10^9$ to $10^{10}$ Ω·cm. When magnetic ceramic or dielectric ceramic having an insulation resistance of approximately $10^9$ to $10^{10}$ Ω·cm is used, a sufficient insulation reliability is ensured. A ceramic material can be selected from a broad class of materials, and a complex electronic component having the desired characteristics can be obtained.

With various electric characteristics being taken into consideration, magnetic ceramic or dielectric ceramic having an insulation resistance of approximately $10^9$ to $10^{10}$ Ω·cm, which is not sufficiently large, is preferred in some cases. In such a case, when the present invention is applied, migration of an inner electrode and a reduction in insulation resistance are prevented. Insulation reliability between devices is increased. As ceramic having an insulation resistance of approximately $10^9$ to $10^{10}$ Ω·cm, for example, ferrite or like material can be used. The present invention can also be applied to a case in which a material other than the above is used.

In the complex electronic component, the insulating member may have an insulation resistance of approximately $10^{12}$ Ω·cm or more. When an insulating member having an insulation resistance of approximately $10^{12}$ Ω·cm or more is used, insulation between devices is enhanced. As an insulating member having an insulation resistance of $10^{12}$ Ω·cm or more, glass including at least one selected from a group consisting of B, Zn, Ca, Al, and Si, or alumina can be used. Other materials can also be used.

In the complex electronic component, the plurality of devices may include at least one device selected from the group consisting of an inductor, a resistor, and a capacitor, for example. In this case, migration of an inner electrode and a reduction in insulation resistance are prevented, and insulation reliability is increased.

When a magnetic ceramic layer is used as a ceramic layer, magnetic ceramic layers and inner electrode layers are alternately laminated, and each inner electrode is electrically connected to each other to form coil-shaped inductors, a compact complex inductor component having a good insulation reliability between the inductors is obtained, without migration of the inner electrodes or a reduction in insulation resistance.

When a magnetic ceramic layer is used as a ceramic layer, and magnetic ceramic layers and inner electrode layers are alternately laminated to form capacitors in the ceramic, a compact complex capacitor component having a good insulation reliability between the capacitors is obtained, without migration of the inner electrodes or a reduction in insulation resistance. In the same way, a resistor can be formed in ceramic.

In a complex electronic component, two devices or more selected from a group consisting of an inductor, a resistor, and a capacitor can also be disposed in ceramic in a combination.

BRIEF DESCRIPTION OF THE DRAWINGS

The foregoing and other features, objects, and advantages of the invention will be better understood by reading the following description in conjunction with the drawings in which:

FIG. 5A is a transparent perspective view of a complex electronic component (complex inductor component) according to a third exemplary embodiment of the present invention;

FIG. 5B is a sectional elevation of the complex electronic component;

DESCRIPTION OF THE PREFERRED EMBODIMENTS

The various features and embodiments of the present invention will be described with reference to the drawings.

Figure 1A:
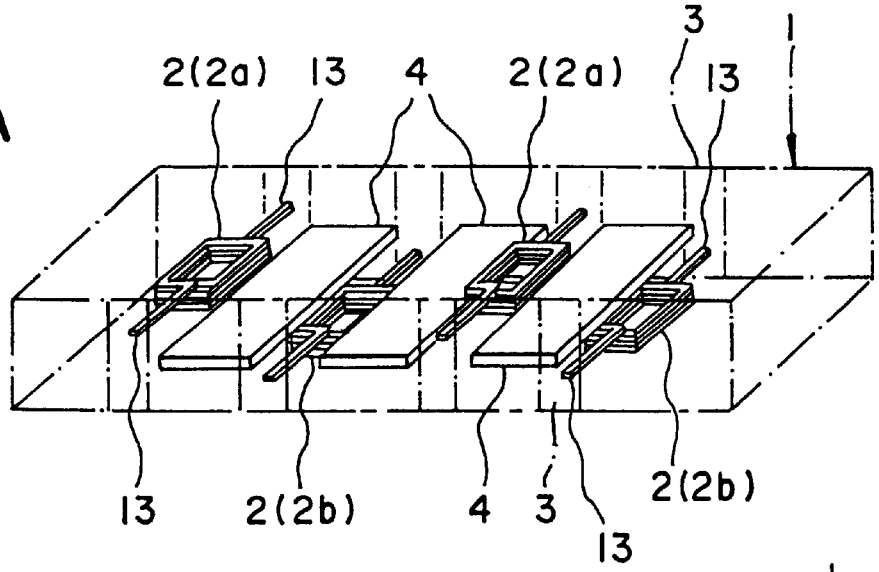
FIG. 1A is a transparent perspective view of a complex electronic component (complex inductor component) according to a first exemplary embodiment of the present invention.
Figure 1B:
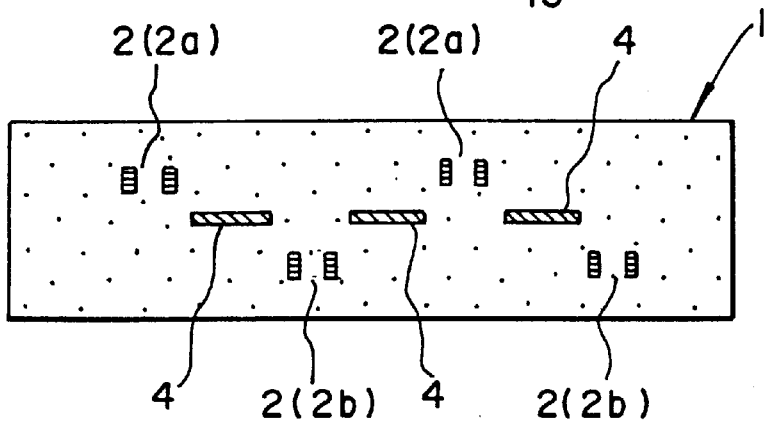
FIG. 1B is a sectional elevation of the complex electronic component.

FIG. 1A is a perspective view of a complex electronic component (complex inductor component in the present embodiment) according to a first exemplary embodiment of the present invention. FIG. 1B is a sectional elevation of the complex electronic component.

As shown in FIGS. 1A and 1B, the complex inductor component of the first embodiment is formed such that a plurality of (e.g., four in the present embodiment) inductors 2 (2*a* and 2*b*) having a coil shape and serving as inner electrode layers 12 (FIG. 2) are disposed in parallel alternately on different planes inside a laminated member 1 formed by laminating magnetic ceramic (ferrite) layers 11. A plurality of (e.g., three in the present embodiment) insulating members 4 are disposed on a layer (intermediate layer) positioned in the middle of the planes on which adjacent inductors 2 (2*a* and 2*b*) are disposed, in the lamination direction. A plurality of outer electrodes 3 which are electrically connected to the inductors 2 through lead electrodes 13 are disposed outside the laminated member 1.

Specifically, adjacent inductors 2*a* and 2*b* are alternately disposed on two different planes (upper layer and lower layer) inside the laminated member 1. In FIG. 1, the inductors 2*a* indicate inductors 2 disposed on one plane (upper layer), and the inductors 2*b* indicate inductors 2 disposed on the other plane (lower layer).

Each insulating member 4 is disposed on an intermediate layer between the upper layer and the lower layer. When viewed from the top, each insulating member 4 is disposed between inductors 2.

Figure 2:
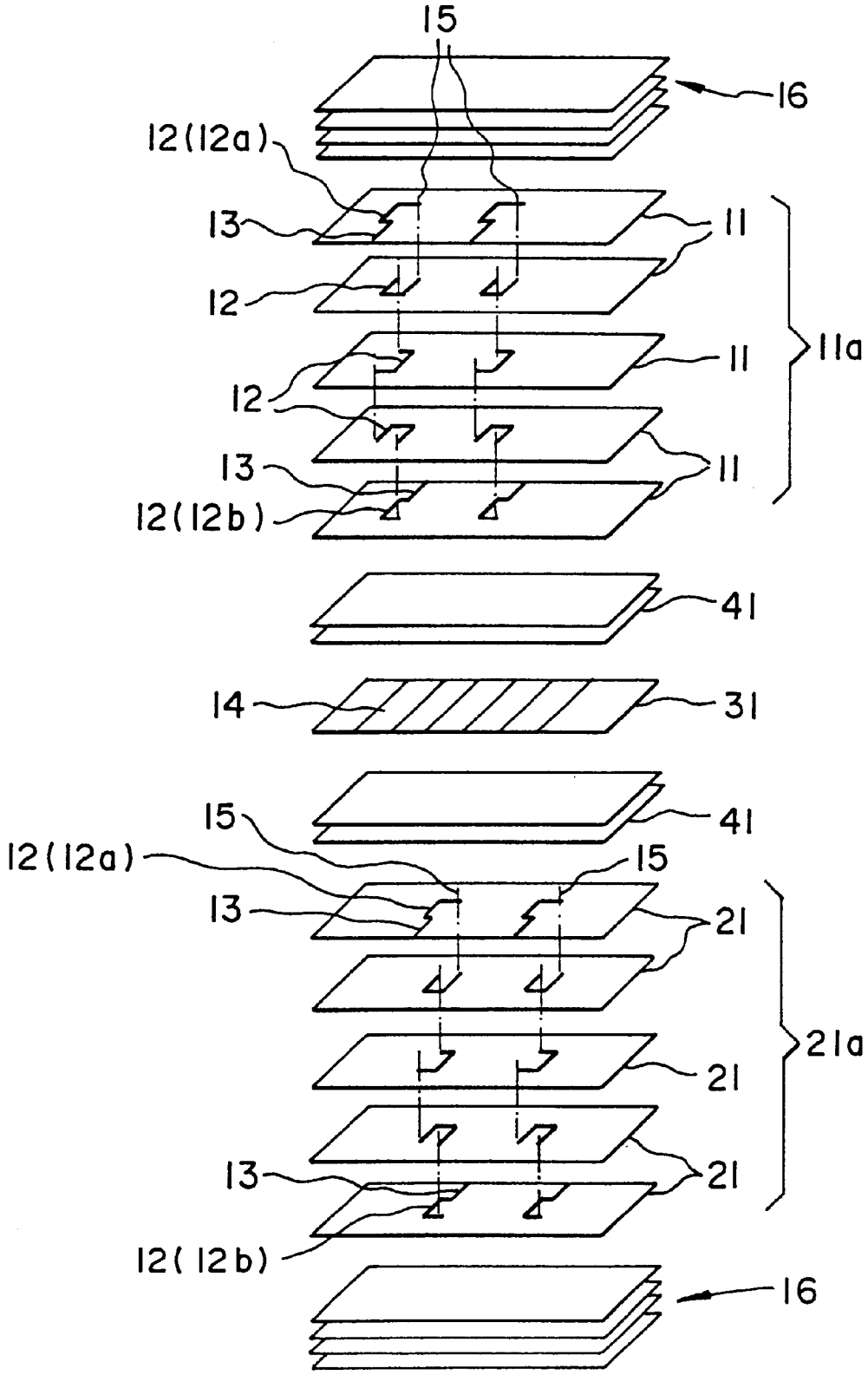
FIG. 2 is a view illustrating a manufacturing method for the complex electronic component (complex inductor component) according to the first embodiment of the present invention.

A manufacturing method for this complex inductor component will be described by referring to FIG. 2. Conductive patterns (inner electrode layers) 12 are disposed at positions where inductors 2 (2*a*) (shown in FIG. 1) are to be formed on a plurality of magnetic ceramic sheets 11 on which through holes 15 are formed at predetermined positions, to form a first magnetic ceramic sheet group 11*a*. Among the conductive patterns 12 in the magnetic ceramic sheet group 11*a*, the conductive patterns 12*a* and 12*b* on the uppermost layer and the lowermost layer are provided integrally with lead electrodes 13.

In the same way conductive patterns (inner electrode layers) 12 are disposed at positions where inductors 2 (2*a*) (shown in FIG. 1) are to be formed on a plurality of magnetic ceramic sheets 21, to form a second magnetic ceramic sheet group 21*a*.

Conductive patterns (inner electrode layers) 12 can be formed, for example, by printing electrically conductive paste on unbaked magnetic ceramic sheets (e.g., green sheets) so as to form the desired patterns.

Between the magnetic ceramic sheet groups 11*a* and 21*a* formed as described above, a magnetic ceramic sheet 31 on which insulating patterns 14 are disposed is placed. Also, a magnetic ceramic sheets 41 on which an insulating pattern or an electrically conductive pattern is not disposed on either side is also placed so as to sandwich the magnetic ceramic sheet 31. Magnetic ceramic sheets 16 on which an electrically conductive pattern is not disposed are laminated on the upper surface of the first magnetic ceramic sheet group 11*a* and on the lower surface of the second magnetic ceramic sheet group 21*a*. All layers are pressed and the conductive patterns 12 formed on the magnetic ceramic sheets 11 and 21 are connected through the through holes 15 to form the coil-shaped inductors 2 (2*a* and 2*b*) (FIG. 1) having a specified number of turns as a whole. A block including a plurality of such units is divided at a certain position and baked.

Figure 3:
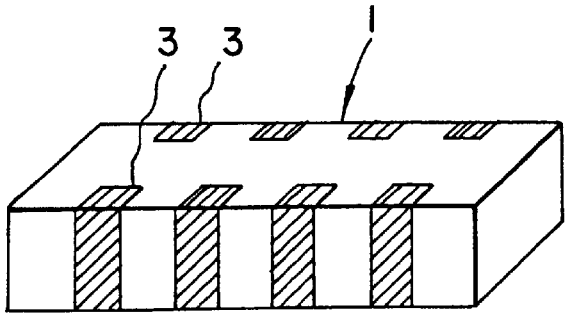
FIG. 3 is a perspective view of the complex electronic component (complex inductor component) according to the first embodiment of the present invention.

A plurality of outer electrodes 3 (FIG. 1) which are electrically connected to the inductors 2 (2*a* and 2*b*) through the lead electrodes 13 are formed at the outer surfaces of the baked laminated member 1 to complete the complex inductor component shown in FIGS. 1 and 3. The outer electrodes 3 can be formed by printing and baking the same electrically conductive paste as that used for forming the inner electrode layers 12 or other electrically conductive paste. The outer electrodes 3 can also be formed by other methods, such as plating or deposition.

Since the adjacent inductors 2 (2*a* and 2*b*) are alternately disposed on different planes and the insulating members 4 are disposed between the inductors 2 (2*a* and 2*b*) in the complex inductor component formed as described above, the component can be made compact to implement high-density mounting. In addition, migration of the inner electrodes and a reduction in the insulation resistance are prevented to enhance insulation between the inductors 2.

Since the inductors 2 (2*a* and 2*b*) are formed in a coil shape, high impedance can be obtained. In addition, since impedance characteristics can be adjusted by changing the number of turns in the coils, noise is effectively canceled.

Because the adjacent inductors 2 (2*a* and 2*b*) are disposed on different planes and the distances between the adjacent inductors 2 (2*a* and 2*b*) can be made longer than in a case in which the inductors 2 (2*a* and 2*b*) are formed on the same plane, magnetic coupling and capacitive coupling are suppressed to improve cross-talk characteristics, and noise and signals are prevented from adversely affecting the inductors to improve reliability in signal transfer.

Figure 4A:
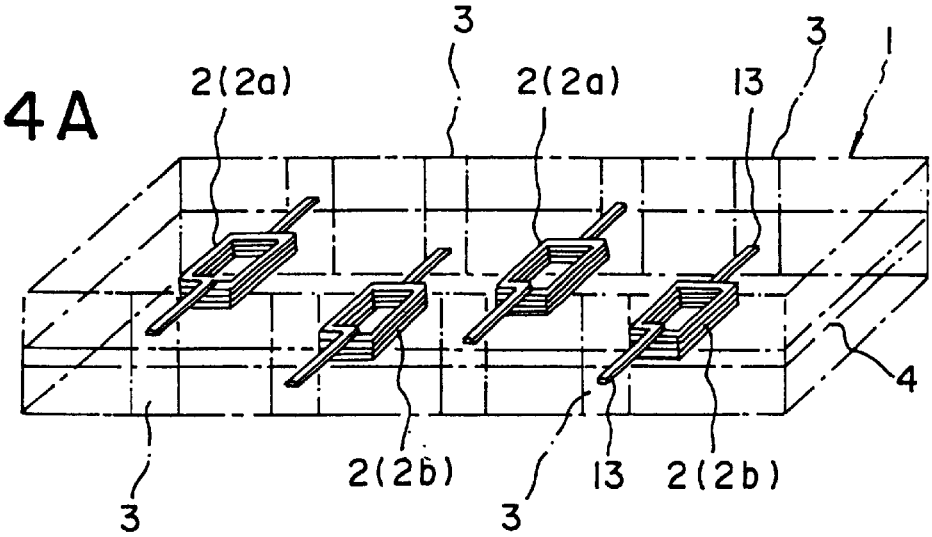
FIG. 4A is a transparent perspective view of a complex electronic component (complex inductor component) according to a second exemplary embodiment of the present invention.
Figure 4B:
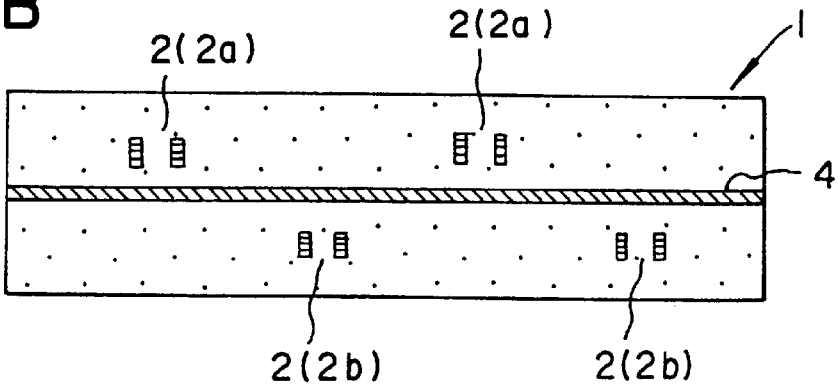
FIG. 4B is a sectional elevation of the complex electronic component.

In the first embodiment, the plurality of insulating members 4 are disposed on the intermediate layer between the upper layer and the lower layer at selected positions (i.e., when viewed from the top as shown in FIG. 1B, between the inductors 2*a* and 2*b*). In other words, the plurality of insulating members 4 are disposed between the inductors 2*a* and 2*b*, when viewed from the top. As shown in FIGS. 4A and 4B, an insulating member 4 may be disposed on the whole surface of the intermediate layer.

In FIGS. 4A and 4B. the symbols which are the same as those used in FIGS. 1A and 1B indicate the same parts as or the corresponding parts to those in the complex inductor component shown in FIGS. 1A and 1B.

Instead of the magnetic ceramic sheet 31 (FIG. 2) on which the three insulating patterns 14 are disposed in the first embodiment, since a magnetic ceramic sheet (not shown) on which an insulating member is disposed on the whole surface is used in a second embodiment, the complex inductor component of the second embodiment can be more easily manufactured.

FIG. 5A is a perspective view of a complex electronic component (complex inductor component) according to a third embodiment of the present invention. FIG. 5B shows a sectional elevation of the component.

As shown in FIGS. 5A and 5B, the complex inductor component of the third embodiment is formed such that a plurality of (e.g. four in the present embodiment) inductors 2 having a coil shape and serving as inner electrode layers 12 (FIG. 6) are disposed in parallel at a predetermined interval on the same plane inside a laminated member 1 formed by laminating magnetic ceramic (ferrite) sheets 51 (FIG. 6), wall-like insulating members 4*a* are disposed between the adjacent inductors 2, and a plurality of outer electrodes 3 which are electrically connected to the inductors 2 through lead electrodes 13 (FIG. 6) are disposed outside the laminated member 1.

Figure 6:
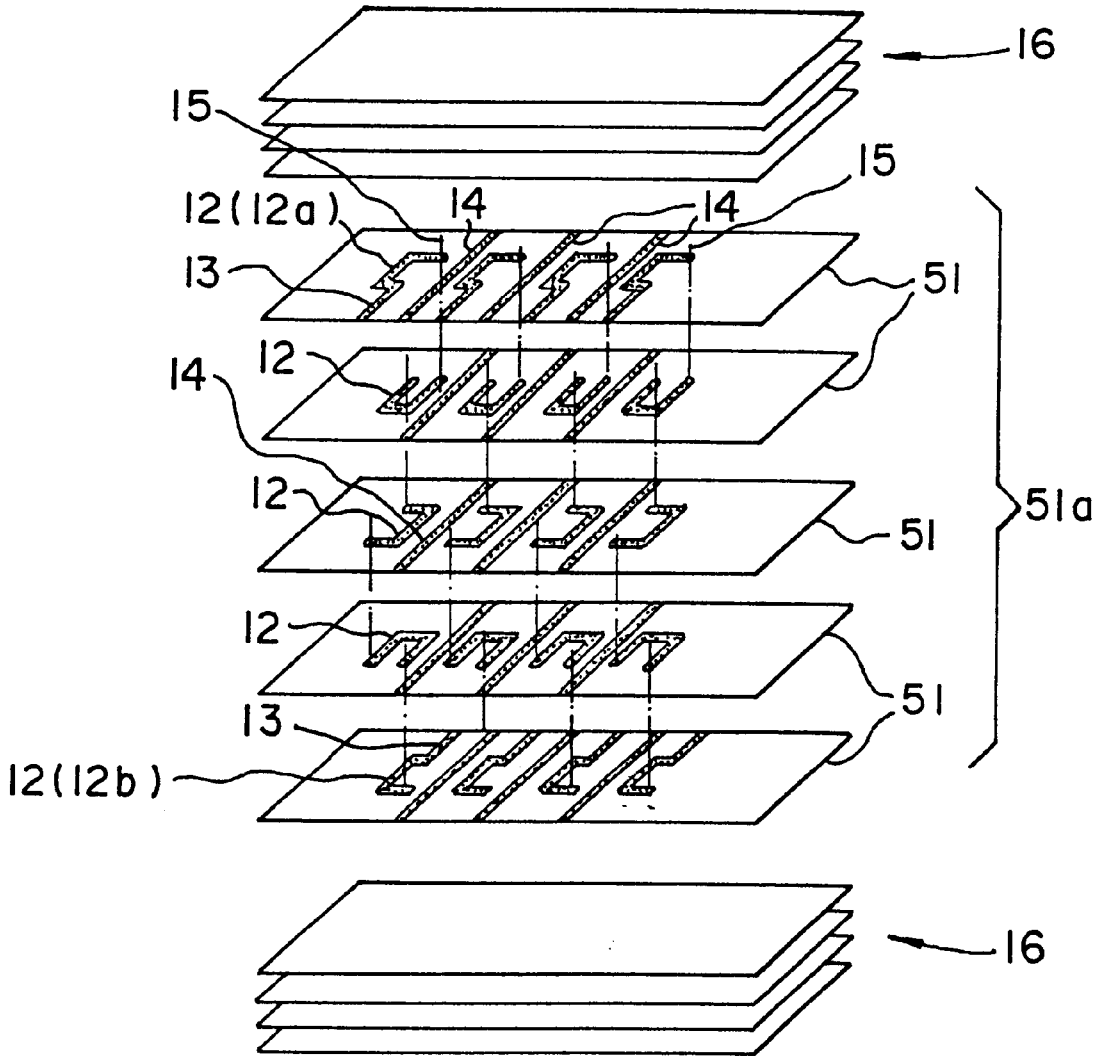
FIG. 6 is a view illustrating a manufacturing method for the complex electronic component (complex inductor component) according to the third embodiment of the present invention.
Figure 7:
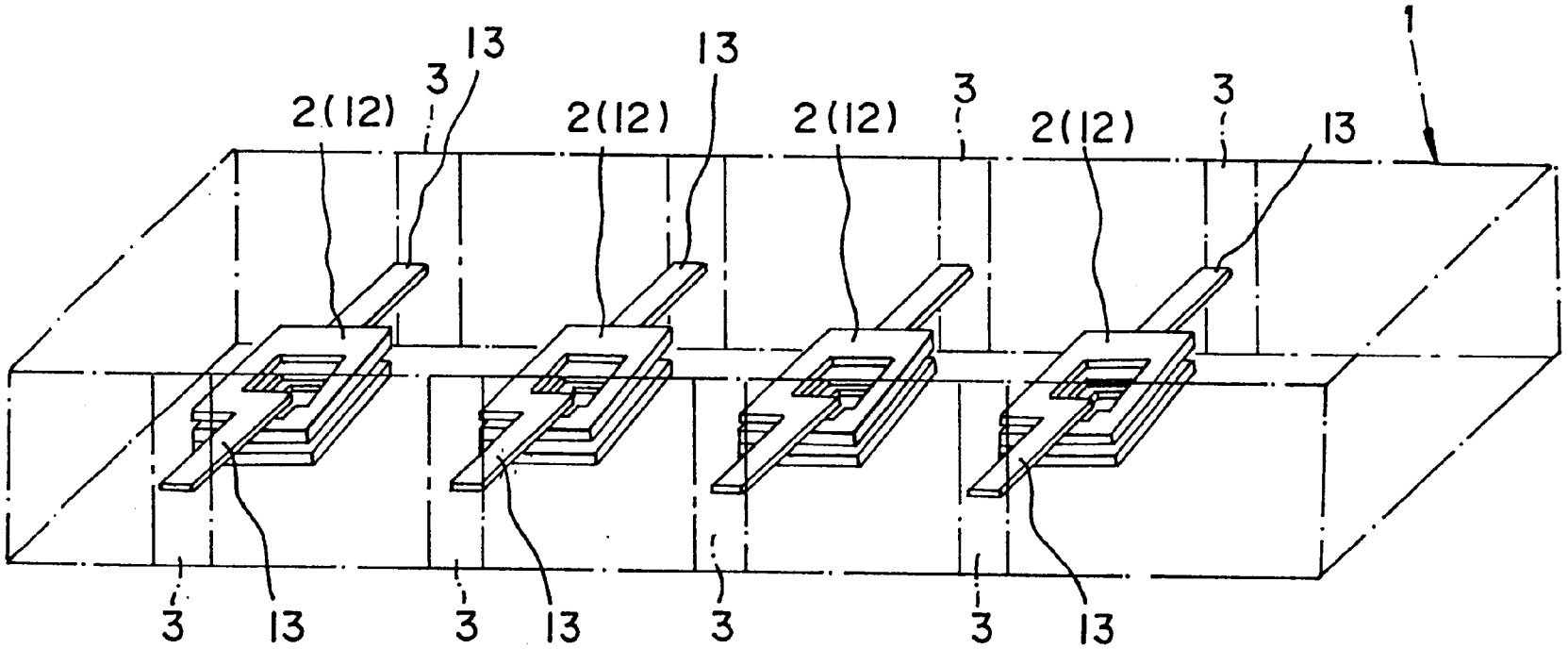
FIG. 7 is a transparent perspective view of a conventional complex electronic component (complex inductor component).

A manufacturing method for this complex inductor component will be described below by referring to FIG. 6. Conductive patterns (inner electrode layers) 12 are disposed at positions where inductors 2 (FIG. 5) are to be formed on a plurality of magnetic ceramic sheets 51 on which through holes 15 are formed at predetermined positions. Moreover insulating patterns 14 are disposed at positions where the wall-like insulating members 4*a* which partitions zones where the adjacent inductors 2 are disposed are to be formed, to form a magnetic ceramic sheet group 51*a*. Among the conductive patterns 12 in the magnetic ceramic sheet group 51*a*, the conductive patterns 12*a* and 12*b* on the uppermost layer and the lowermost layer are provided integrally with lead electrodes 13.

Magnetic ceramic sheets 16 on which an electrically conductive pattern is not disposed are laminated on the upper surface and the lower surface of the magnetic ceramic sheet group 51*a* so as to sandwich the magnetic ceramic sheet group 51*a* formed as described above, and are stacked and pressed. The conductive patterns 12 formed on the magnetic ceramic sheets 51 are connected through the through holes 15 to form the coil-shaped inductors 2 having a specified number of turns as a whole. A block including a plurality of such units is divided at a predetermined position and baked.

A plurality of outer electrodes 3 (FIG. 5A) which are electrically connected to the inductors 2 through the lead electrodes 13 are formed at the outer surfaces of the baked laminated member 1 to complete the complex inductor component shown in FIG. 5A.

Since the wall-like insulating members 4*a* are formed so as to partition zones where the inductors 2 are disposed, by laminating insulating elements 4 (FIG. 5) between the adjacent inductors 2 in the complex inductor component formed as described above, the adjacent inductors 2 are more efficiently insulated. Migration of the inner electrodes and a reduction in insulation resistance are prevented to further increase insulation between the inductors 2.

The wall-like insulating members can be easily formed by laminating ceramic green sheets on which insulating patterns are disposed. The wall-like insulating members can also be formed by other methods.

In the first and second embodiments, four inductors are disposed in the complex inductor components. The number of the disposed inductors is not limited and can be increased or reduced to suit a particular application. In the above embodiments, a plurality of inductors are aligned straight in line when viewed from the top. The inductors may also be disposed in a zigzag manner, for example. In this case, the distances between the inductors can be made longer than those in a case in which the inductors are disposed in a straight line.

In a complex electronic component according to the present invention, the shape or the number of turns of a coil pattern which forms an inductor is not limited. A preferred shape and the preferred number of turns can be selected to suit a particular application.

In the above embodiments, the "device" comprises an inductor (a coil device), for example. The type of the device is not limited to an inductor, however. The present invention can also be applied to a resistor, a capacitor, or other type of device, for example.

The other above-described features should also not be construed as limiting the invention. The shapes and the materials of a device and an outer electrode can be changed and modified in various ways within the spirit and scope of the invention.

The preferred embodiments are merely illustrative and should not be considered restrictive in any way. The scope of the invention is to be measured by the appended claims, rather than the preceding description, and all variations and equivalents which fall within the range of the claims are intended to be embraced therein.

What we claim is:

1. A complex electronic component comprising:

at least two devices disposed in parallel within a ceramic material; and an insulating member disposed between the at least two adjacent devices to enhance insulation between the two adjacent devices;

wherein there are at least three devices all of which are located on the same plane within the ceramic material.

* * * * *